United States Patent [19]

Fields

[11] Patent Number: 4,651,636

[45] Date of Patent: Mar. 24, 1987

[54] ADJUSTABLE CONE FOR HYDRA EXTRACTOR

[75] Inventor: Evan P. Fields, Pomeroy, Pa.

[73] Assignee: Somat Corporation, Pomeroy, Pa.

[21] Appl. No.: 767,475

[22] Filed: Aug. 20, 1985

[51] Int. Cl.[4] ..... B30B 9/14

[52] U.S. Cl. ..... 100/95; 100/98 R; 100/117; 100/127; 100/149

[58] Field of Search ..... 100/117, 98 R, 126, 100/127, 145–150, 95

[56] References Cited

U.S. PATENT DOCUMENTS 3,188,942 6/1965 Wandel ..... 100/117 X 3,426,677 2/1969 Combs ..... 100/117

4,212,239 7/1980 Fraula ..... 100/117 X

*Primary Examiner*—Billy J. Wilhite

*Attorney, Agent, or Firm*—Kane, Dalsimer, Kane, Sullivan and Kurucz

[57] ABSTRACT

A hydra-extractor includes an extractor screw and dewatering chamber, a cone for directing dried material to a plug cutter, the plug cutter, and a discharge chute. Associated power apparatus is mounted on the hydra-extractor. A novel cone is provided which is hyberolic in shape, composed of a high density urethane, and separable into two parts. The cone is affixed to the plug cutter which is also separable into two parts. The plug cutter is affixed to and rotated by the extractor screw shaft.

7 Claims, 4 Drawing Figures

ADJUSTABLE CONE FOR HYDRA EXTRACTOR

CROSS REFERENCE TO RELATED PATENTS

The hydra-extractor of the present invention is an improvement over the commonly assigned apparatus of U.S. Pat. Nos. 3,394,649, and 4,155,299.

BACKGROUND OF THE INVENTION

This invention relates generally to devices for extracting water and other liquids from liquid impregnated materials, such as waste, pulp, raw sewage and waste water in general, and more particularly, to such a unit employing an inverted, hyperbolic two-part cone.

The device which is the subject of this invention finds particular use with a waste disposal apparatus or system wherein upon treatment of the waste material, means must be provided for separating the solids and the liquids from within a slurry. This waste disposal system in general, may or may not include a pulper having a tank containing the waste material, fibrous material, garbage and other disposable waste in the presence of a high percentage of water, all being subjected to the disintegrating action of a rotatable impeller having suitable material disintegrating cutters. (see commonly assigned U.S. Pat. Nos. 2,729,146; 3,164,329; 3,584,800; 3,620,460 and 3,885,745.) In apparatus of this type there is associated with the tank discharge, a means for delivering the water-laden material to a liquid extracting device often referred to as a hydra-extractor in which a helical screw is made to undergo rotation within a cylindrical sieve. The hydra-extractor separates the solids from the liquids by withdrawing the liquid from the material received from the pulper or selected disintegrating or mascerating unit. In U.S. Pat. No. 3,394,649, having a common assignee with this application, there is disclosed such a hydra-extractor in which there is a cylindrical screen or hollow cylindrical sieve surrounding the major portion of the screw.

The hydra-extractor must be designed so that it will efficiently separate the liquids and the solids and not overload the screw during the process. Additionally, the back pressure or pressure against which the material moves on the helical screw must be maintained within predetermined limits and the device must be capable of operating almost immediately after shutdown during which period materials within the device can dry and harden and often tend to raise the back pressure.

In the past cones have commonly been composed of brass to minimize corrosiveness. In addition, prior art plug cutters and cones have been composed of an integral material and coupled with the screw shaft, leading to difficulties in installation, replacement, and maintenance.

Prior art hydra-extractors employing V-shaped cones having flat sides have also encountered problems with adhesion of pulp to the cone resulting in drag upon the flow of drying material and increased back pressure.

SUMMARY OF THE INVENTION

It is an object of the present invention to provide a hydra-extractor of the type described above in which back pressure can be adjusted simply by adjusting the cutter, or replacing the cone with a cone of varied size.

Another objective is to provide a cone and cutter of a two piece construction in order to facilitate installation replacement and maintenance. The cone and cutter of the present invention are connected to one another and the cutter is connected to the shaft.

It is a further objective to provide an apparatus of the foregoing type in which the cone is of a hyperbolic shape, eliminating the problem of adhesion of pulp to the surface of the cone, and reducing drag.

To achieve the above objects the present invention provides an extractor apparatus for separating liquid from a liquid-solid mixture comprising a receiving means for receiving a liquid-solid mixture a drawing means, extending upwardly from the receiving means, for drawing the liquid-solid mixture through a dewatering chamber a dewatering means for separating slurry into plug material and water a guiding means for directing plug material to a plug cutter, the guiding means comprising an inverted truncated cone having a hyperbolic configuration the plug cutter and a means for collecting the cut plug material.

DETAILED DESCRIPTION OF THE PREFERRED EMBODIMENT

Figure 1:
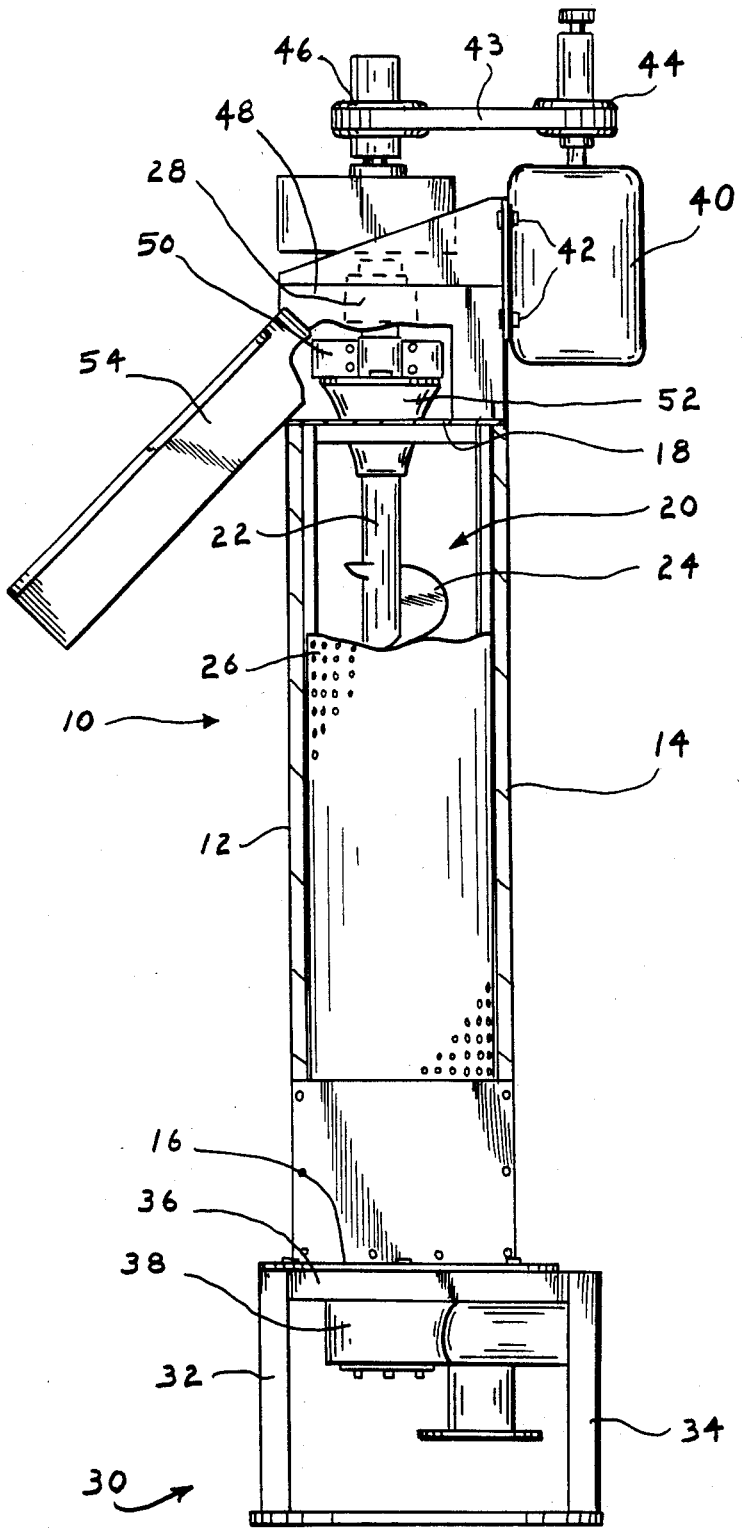
FIG. 1 is a side elevation view of a liquid extracting device with portions cut away revealing details of construction.

Referring now to the drawings, in FIG. 1 there is shown a liquid extracting device 10 having a shell consisting of vertically extending members 12 and 14 and end members 16 and 18 at either end.

The screw 20 of the hydra-extractor consists of a cylindrical screw shaft 22 having flights 24 providing an inclined surface in the form of a helix or screw surrounding and attached to the shaft. Flights 24 may be either half pitch, having approximately a nine inch diameter and four and one-half inches between flights, or full pitch, having approximately a nine inch diameter and nine inches between flights. A cylindrical screen assembly 26 surrounds the major portion of screw 20. One end of shaft 22 is supported in end bearing 28 and the other end of shaft 22 is supported in a second end bearing not shown.

Disposed beneath the screw is an upright stand 30 having legs 32 and 34 and top plate 36. Bottom pot 38 is affixed beneath top plate 36 and receives the slurry to be dewatered.

A motor 40 is affixed to the extractor shell by bolts 42. Motor 40 is a conventional variable speed electric motor. Motor 40 drives belt 43 through control pulley 44. Pulley 46 transmits the rotational force to shaft 22. Casing 48 contains a reducer shaft. Plug cutter 50 is affixed to shaft 22 and rotates in accordance therewith. Cone 52 is disposed beneath plug cutter 50 and is mounted on shaft 22. Cone 52 is truncated, mounted in inverted fashion, and is hyperbolic in shape in order to direct the flow of dried material to the plug cutter with reduced drag. Dewatered slurry reaching cone 52 is called plug material. Cone 52 is preferably composed of a high density urethane for improved machinability, lower cost and improved wear resistance. A chute 54 is provided to direct the dried and cut plug material from the extractor to a collecting area.

Figure 2:
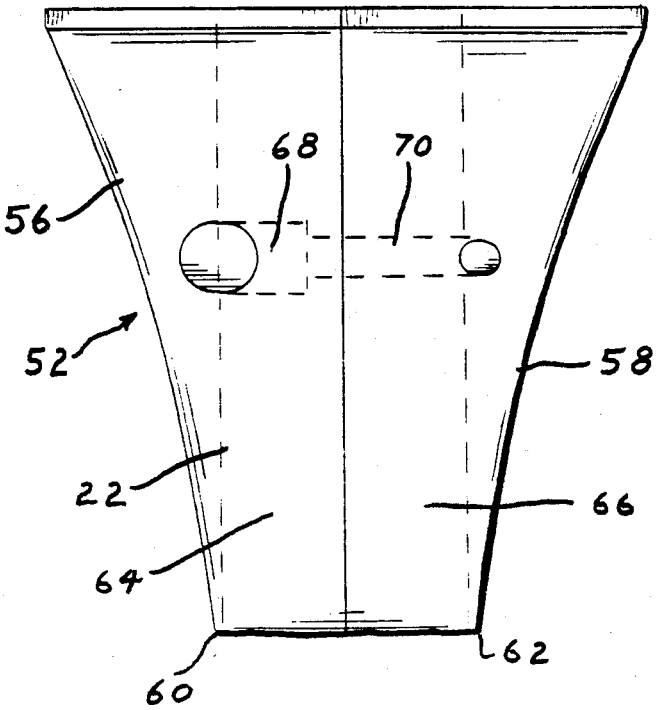
FIG. 2 is a side elevational view of a cone in accordance with the present invention.

FIG. 2 illustrates cone 52 which is preferably composed of a high density urethane. Cone 52 is a truncated cone and is mounted in an inverted manner as shown. Sides 56 and 58 of the cone are arcuate so that the cone forms an inverted hyperbola. At the upstream end of the cone there are break edges 60 and 62. Wherein the side of the cone is immediately adjacent the screw shaft 22. Break edges 60 and 62 strip plug material from screw shaft 22 and direct upwardly pushed plug material to the plug cutter.

Figure 3:
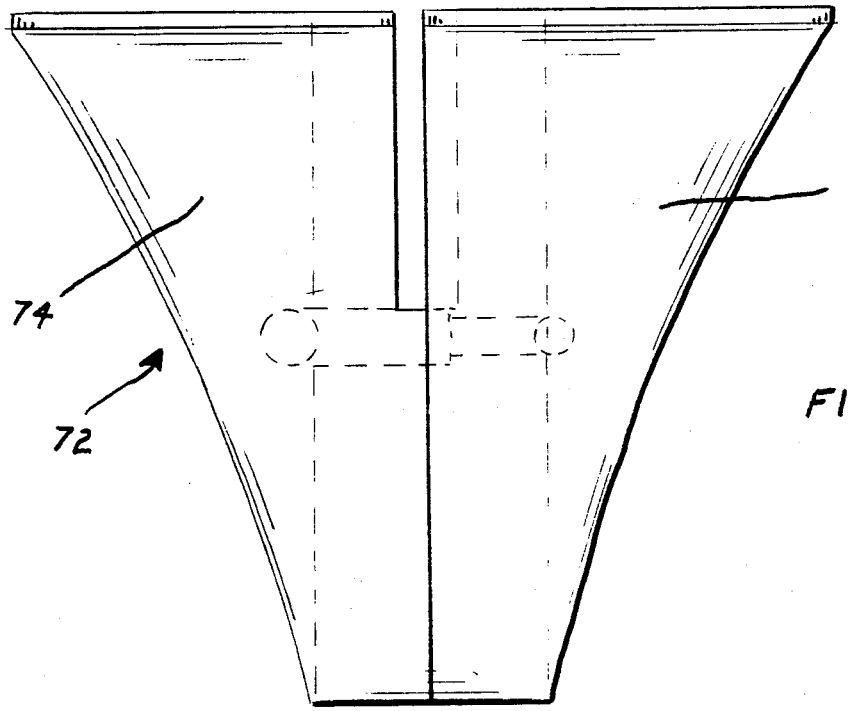
FIG. 3 is a side elevational view of an alternate embodiment of a cone in accordance with the present invention.

Cone 52 is composed of two separable parts 64 and 66. The two parts are bolted together by a bolt (not shown) into tapped spaces 68 and 70 respectively. The two parts 64 and 66 are readily separable and removable from screw shaft 22 for ease in installation and replacement. Cone 52 may be replaced by larger cone 72 of FIG. 3 in order to slow flow rate of plug material past the cone. In this manner the dewatering process is allowed to develop further due to increased residence time of the slurry in the hydra-extractor 10, resulting in a drier plug material passing to the plug cutter. Cone 72 is also comprised of two parts, 74 and 76, for ease in replacement.

Figure 4:
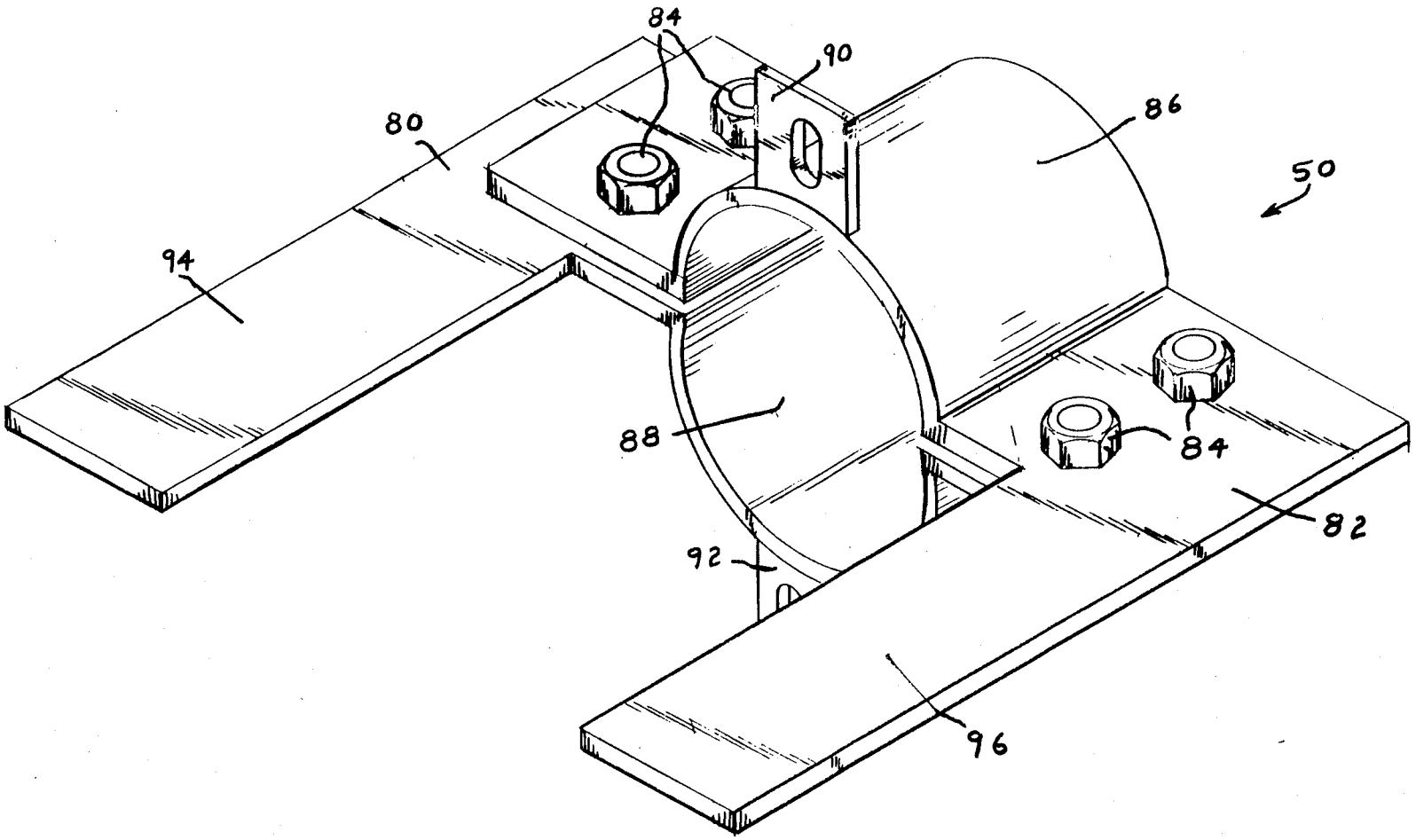
FIG. 4 is perspective view of the plug cutter housing.

FIG. 4 illustrates the plug cutter 50. The plug cutter is also divided into two readily separable parts 80 and 82 which are secured by bolts 84. Semi-cylindrical sections 86 and 88 combine to form a tubular section adapted to be affixed to the screw shaft 22. Flanges 90 and 92 extend from sections 86 and 88 respectively and are adapted to secure the plug cutter to cone 52. Blades 94 and 96 extend from the plug cutter and cut plug material as the plug cutter is rotated by the screw shaft 22.

In the operation of the present invention slurry is received into bottom pot 38 and drawn into the extractor chamber by screw 20. Water in the slurry drains through cylindrical screen assembly 26 as the slurry rises in the extractor chamber. Dried slurry, referred to as plug material, collects at the upper part of the chamber and is pushed upwardly to cone 52. Cone 52 directs the plug material to plug cutter 50 where it is cut and discharged through chute 54 to be collected.

Although a detailed description of the invention has been given, it is to be understood that the scope of the invention is not limited thereby, but is to be determined by the claims which follow.

What is claimed is:

1. An extractor apparatus for separating liquids from solids in a liquid-solid mixture comprising:

a receiving means for receiving a liquid-solid mixture;

a drawing means, extending substantially vertically from the receiving means, for drawing the liquid-solid mixture through a dewatering chamber;

a dewatering means for separating slurry into plug material and liquid;

a guiding means for directing plug material to a plug cutter, the guiding means comprising an inverted truncated cone having a hyperbolic configuration to reduce adhesion of pulp to the cone, said guiding means being composed of first and second readily separable parts;

the plug cutter located above the guiding means and being composed of two readily separable parts, each part comprising a semi-cylindrical section, the parts being affixed together to form a tubular section having cutting blades extending radially therefrom for cutting plug material; and a means for collecting the cut plug material.

2. An extractor according to claim 1 comprising bolts affixing the first and second readily separable parts of the cone together.

3. An extractor apparatus according to claim 1 wherein the two-part plug cutter is affixed to the two-part cone for ease of replacement and maintenance, the blades of the plug cutter being axially directed toward the drawing means to cut plug material as it passes the guiding means.

4. An extractor apparatus according to claim 1 wherein the cone is composed of a high density urethane.

5. An extractor apparatus according to claim 1 wherein the parts of the cone are bolted together and are readily accessible within the extractor for replacement.

6. An extractor apparatus according to claim 1 further comprising a variable speed motor driving the drawing means and the plug cutter, wherein the plug cutter is a variable speed plug cutter, the speed being variable to adjust the rate of dewatering.

7. An extractor apparatus according to claim 1 wherein the cone is referred to as the first cone and wherein the first cone is replaceable by a second truncated hyperbolic cone of different diameter than the first cone in order to adjust the rate of dewatering.

* * * * *